US009038224B1

(12) United States Patent
Esquibel

(10) Patent No.: US 9,038,224 B1
(45) Date of Patent: May 26, 2015

(54) EXFOLIATING BRUSH ASSEMBLY

(71) Applicant: Nathan N. Esquibel, Lafayette, CO (US)

(72) Inventor: Nathan N. Esquibel, Lafayette, CO (US)

( * ) Notice: Subject to any disclaimer, the term of this patent is extended or adjusted under 35 U.S.C. 154(b) by 145 days.

(21) Appl. No.: 13/778,368

(22) Filed: Feb. 27, 2013

(51) Int. Cl.

| | |
|---|---|
| ***A46B 13/02*** | (2006.01) |
| ***A46B 7/04*** | (2006.01) |
| ***A45D 24/16*** | (2006.01) |
| ***A45D 24/14*** | (2006.01) |
| ***A47K 7/04*** | (2006.01) |
| *A46B 5/00* | (2006.01) |
| *A45D 24/00* | (2006.01) |

(52) U.S. Cl.
CPC ..... *A46B 13/023* (2013.01); *A46B 7/044* (2013.01); *A46B 5/0095* (2013.01); *A45D 24/16* (2013.01); *A45D 24/14* (2013.01); *A45D 24/007* (2013.01); *A47K 7/043* (2013.01)

(58) Field of Classification Search
CPC ..... A61H 1/00; A61H 7/00; A61H 7/001; A61H 7/002; A61H 7/003; A61H 7/005; A61H 7/007; A61H 11/00; A61H 2201/0115; A61H 2201/0153; A61H 2201/0157; A61H 2205/00; A61H 2205/02; A61H 2205/021; A46B 13/023; A45D 24/14; A45D 24/16
USPC ..... 15/22.1, 176.1–176.6; 601/46, 53, 54, 601/67, 69, 70, 72, 73, 80, 84, 89, 92, 93, 601/94, 95, 108, 109, 111, 136, 137, 138; 132/219, 108, 119.1, 120, 126, 142, 132/148, 152
See application file for complete search history.

(56) References Cited

U.S. PATENT DOCUMENTS

| | | | | | |
|---|---|---|---|---|---|
| 2,489,582 | A | * | 11/1949 | McCready | 15/22.1 |
| 3,231,917 | A | * | 2/1966 | Reed | 15/98 |
| 3,277,509 | A | * | 10/1966 | Sator et al. | 15/176.6 |
| 3,358,309 | A | * | 12/1967 | Richardson | 15/22.1 |
| 3,540,160 | A | * | 11/1970 | De Rose et al. | 451/344 |
| 4,027,984 | A | | 6/1977 | Underwood | |
| D245,857 | S | | 9/1977 | Grube | |
| 4,685,423 | A | * | 8/1987 | Baker et al. | 119/605 |
| 4,964,398 | A | | 10/1990 | Jones | |
| 5,435,328 | A | * | 7/1995 | Grohoske | 132/120 |
| 5,622,192 | A | * | 4/1997 | Chiou | 132/112 |
| 5,978,999 | A | * | 11/1999 | deBlois et al. | 15/22.1 |
| 6,283,930 | B1 | | 9/2001 | Purvis et al. | |
| 7,165,285 | B1 | * | 1/2007 | Hajianpour | 15/28 |

(Continued)

FOREIGN PATENT DOCUMENTS

GB 2288323 A * 10/1995 ..... A46B 13/02

*Primary Examiner* — Mark Spisich
*Assistant Examiner* — Andrew A Horton

(57) ABSTRACT

An exfoliating brush assembly provides different attachments to scrub, stimulate, and exfoliate a user's scalp and body. The assembly includes a head having a bottom side and a peripheral wall extending upwardly from the bottom side. A groove extends through the bottom side and upwardly into the peripheral wall. A plurality of washing assemblies is each selectively couplable to the head wherein the washing assemblies are configured for cleaning the user. Each of the washing assemblies has a tab corresponding to the groove such that the tab is configured to interlock with the groove when the tab is slidably inserted into the groove. A vibrational unit and a battery compartment are positioned in the head. The battery compartment is configured for holding a battery and is electrically coupled to the vibrational unit wherein the battery compartment activates the vibrational unit when the battery delivers power to the vibrational unit.

13 Claims, 4 Drawing Sheets

(56) References Cited

U.S. PATENT DOCUMENTS

| | | | | |
|---|---|---|---|---|
| 7,927,294 | B2 | 4/2011 | Kamimura et al. | |
| 7,963,253 | B1 * | 6/2011 | Bauknecht | 119/608 |
| 2004/0172779 | A1 | 9/2004 | Zhadanov et al. | |
| 2006/0168746 | A1 * | 8/2006 | Guyuron et al. | 15/97.1 |
| 2007/0095362 | A1 * | 5/2007 | Koopah | 134/1 |
| 2007/0180637 | A1 * | 8/2007 | McKay | 15/22.1 |
| 2008/0234611 | A1 | 9/2008 | Sakai et al. | |
| 2011/0009883 | A1 * | 1/2011 | Khubani | 606/133 |
| 2011/0017225 | A1 * | 1/2011 | Devulapalli | 132/118 |
| 2011/0138556 | A1 * | 6/2011 | Sanchez Martinez | 15/145 |
| 2011/0185521 | A1 | 8/2011 | Temple | |

* cited by examiner

EXFOLIATING BRUSH ASSEMBLY

BACKGROUND OF THE DISCLOSURE

Field of the Disclosure

The disclosure relates to brush assemblies and more particularly pertains to a new brush assembly for providing different attachments to scrub, stimulate, and exfoliate a user's scalp and body while also detangling a user's hair.

SUMMARY OF THE DISCLOSURE

An embodiment of the disclosure meets the needs presented above by generally comprising a head having a bottom side and a peripheral wall extending upwardly from the bottom side. A groove extends through the bottom side and upwardly into the peripheral wall. A plurality of washing assemblies is each selectively couplable to the head wherein the washing assemblies are configured for cleaning the user. Each of the washing assemblies has a tab corresponding to the groove such that the tab is configured to interlock with the groove when the tab is slidably inserted into the groove. A vibrational unit and a battery compartment are positioned in the head. The battery compartment is configured for holding a battery and is electrically coupled to the vibrational unit wherein the battery compartment activates the vibrational unit when the battery delivers power to the vibrational unit.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
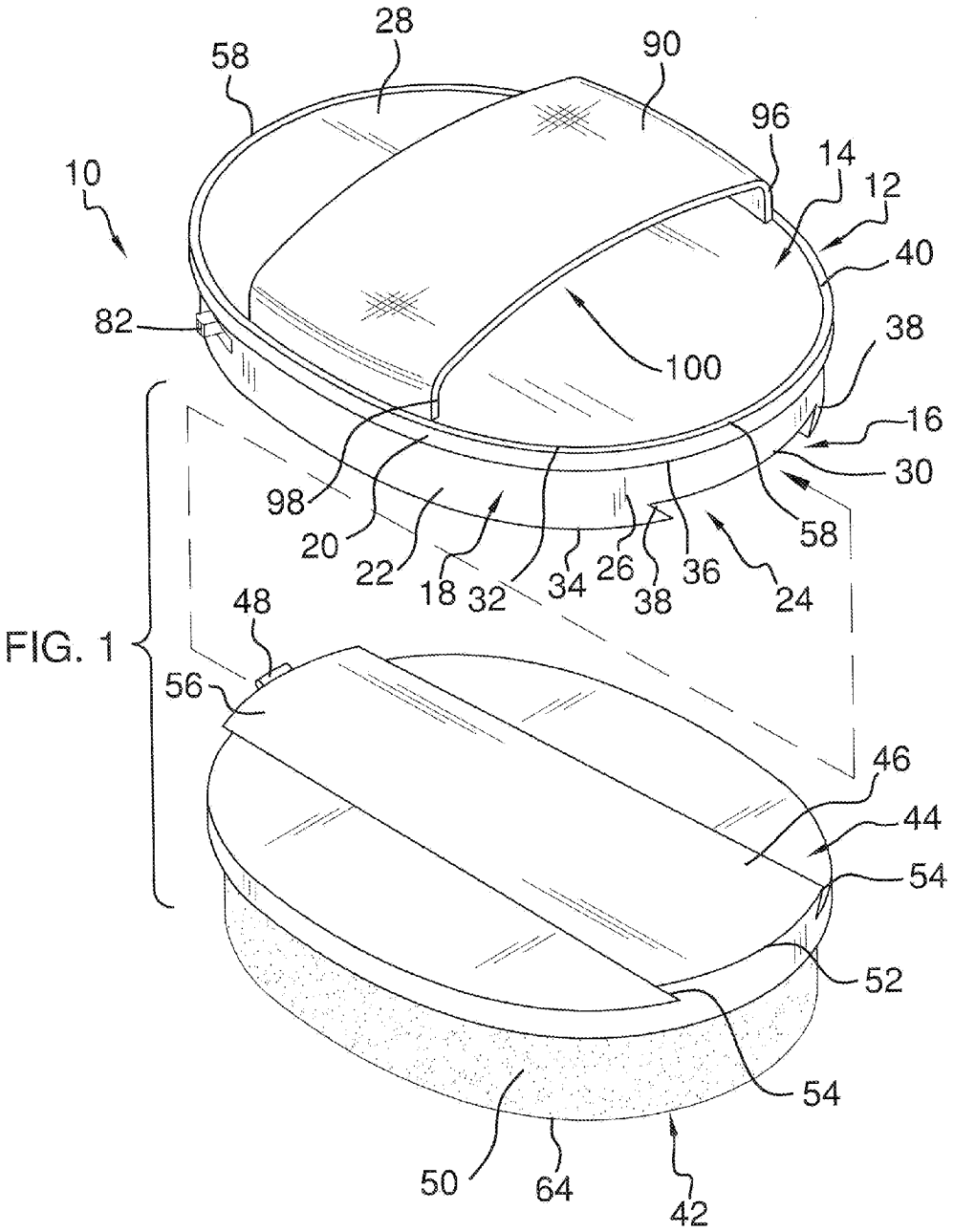
FIG. 1 is a partially-exploded top front side perspective view of an exfoliating brush assembly according to an embodiment of the disclosure.
Figure 2:
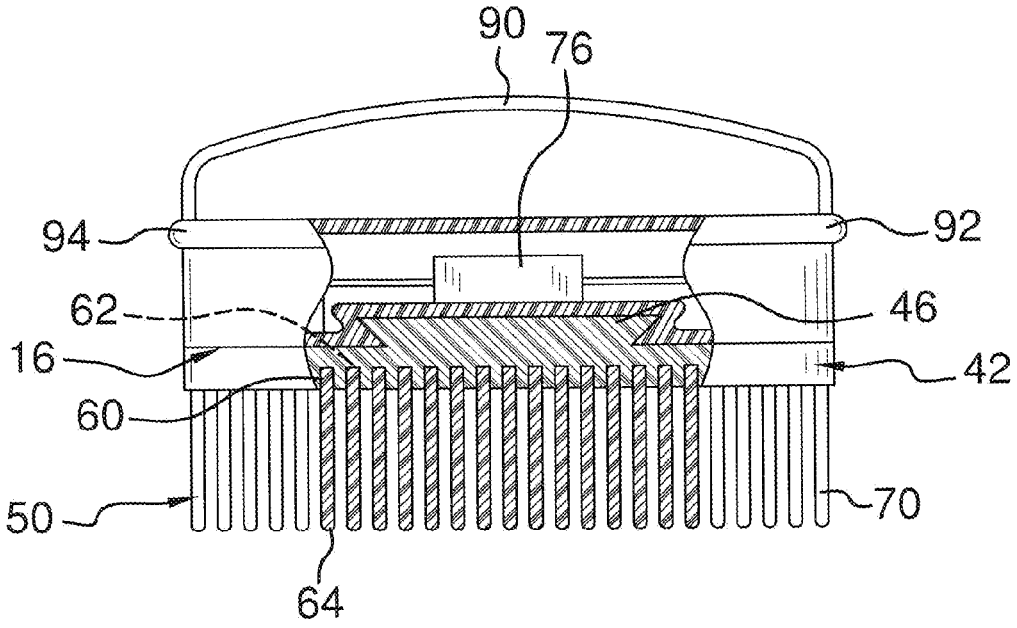
FIG. 2 is a side view of an embodiment of the disclosure.
Figure 3:
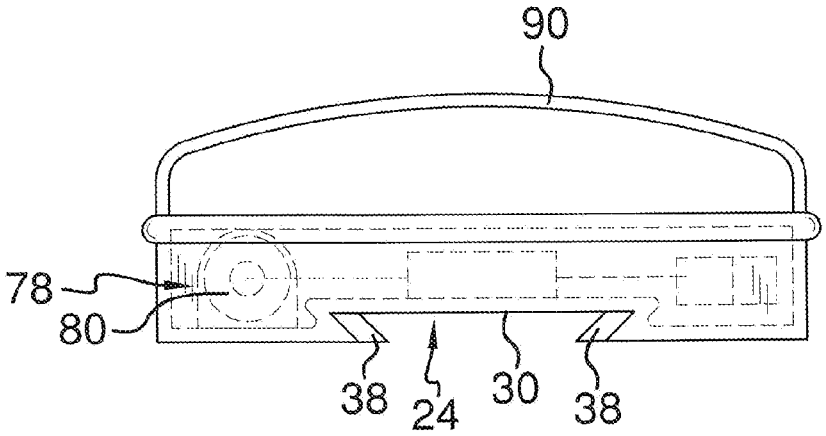
FIG. 3 is a side view of an embodiment of the disclosure.
Figure 4:
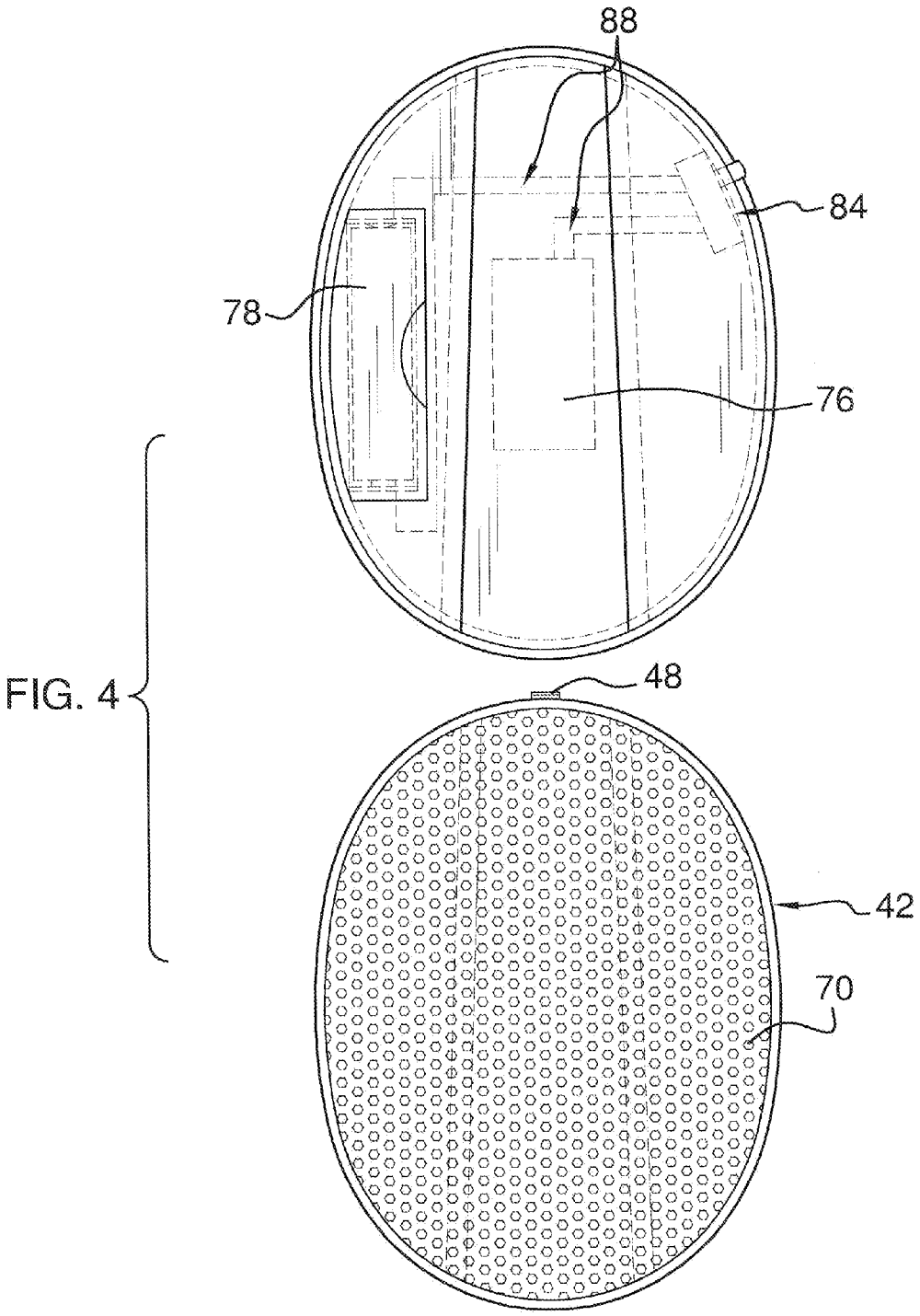
FIG. 4 is a partially-exploded bottom view of an embodiment of the disclosure.
Figure 5:
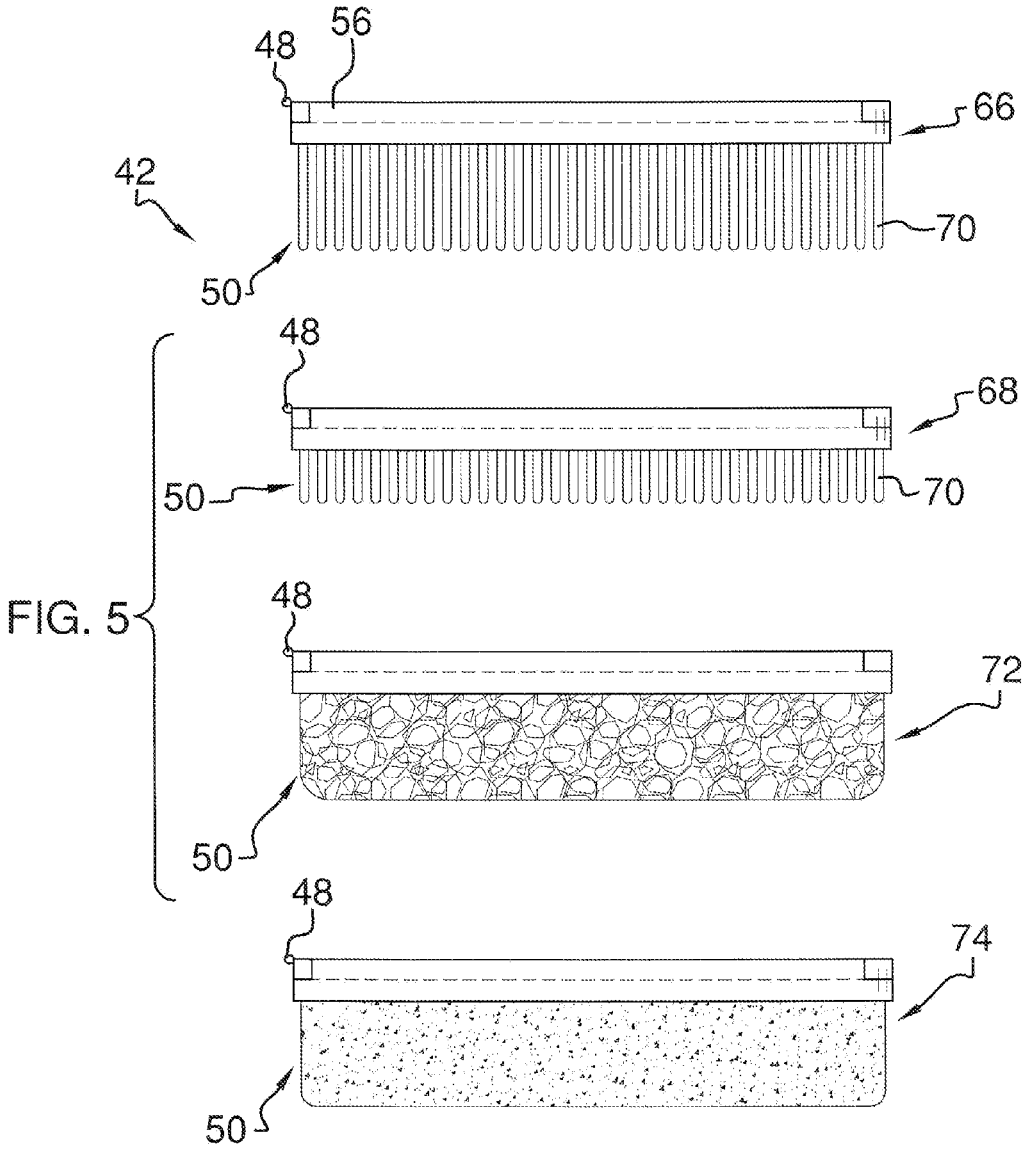
FIG. 5 is a side view of a plurality of washing assemblies of an embodiment of the disclosure.

With reference now to the drawings, and in particular to FIGS. 1 through 5 thereof, a new brush assembly embodying the principles and concepts of an embodiment of the disclosure and generally designated by the reference numeral 10 will be described.

As best illustrated in FIGS. 1 through 5, the exfoliating brush assembly 10 generally comprises a head 12 having a top side 14, a bottom side 16, and a peripheral wall 18 extending between the top side 14 and the bottom side 16. The peripheral wall 18 has an upper portion 20 coupled to a lower portion 22. The head 12 is substantially oval-shaped. A groove 24 extends through the bottom side 16 wherein the groove 24 extends from a first side 26 to a second side 28 of the head 12. The groove 24 extends upwardly into the lower portion 22 of the peripheral wall 18. A top edge 30 of the groove 24 is offset from a top peripheral edge 32 and a bottom peripheral edge 34 of the head 12. The top edge 30 of the groove 24 is parallel to a bottom perimeter edge 36 of the upper portion 20 of the peripheral wall 18. The groove 24 has a pair of angled side portions 38. The side portions 38 couple the top edge 30 of the groove 24 and the bottom peripheral edge 34 of the head 12. The side portions 38 extend upwardly and outwardly from the bottom peripheral edge 34. A lip 40 extends outwardly from the top peripheral edge 32. The lip 40 extends a full length around the top side 14 of the head 12. The lip 40 is coupled to the upper portion 20 of the peripheral wall 18.

A plurality of washing assemblies 42 is provided. Each of the washing assemblies 42 is selectively couplable to the bottom side 16. Each of the washing assemblies 42 comprises a top surface 44, an upwardly projecting tab 46, a locking mechanism 48, and a cleaning attachment 50. The top surface 44 is substantially oval-shaped and is coupled to the tab 46. The tab 46 has a top edge 52 coupled to a pair of angled side portions 54 wherein the tab 46 has a size and shape corresponding to the groove 24 such that the tab 46 is configured to interlock with the groove 24 when the tab 46 is slidably inserted into the groove 24. The locking mechanism 48 is coupled to the tab 46 wherein the locking mechanism 48 is configured to couple the head 12 to an associated one of the washing assemblies 42. The locking mechanism 48 is coupled to a first end 56 of the tab 46 and is centrally positioned on the top edge 52 of the tab 46. The cleaning attachment 50 extends downwardly from the top surface 44. The cleaning attachment 50 extends from the first side 26 to the second side 28 of the head 12 and further extends between a pair of opposite ends 58 of the head 12. A first end 60 of the cleaning attachment 50 is positioned in an interior space 62 of the top surface 44. A second end 64 of the cleaning attachment 50 is positioned opposite the first end 60 of the cleaning attachment 50 wherein the second end 64 of the cleaning attachment 50 is configured for cleaning a user.

The cleaning attachment 50 of a first 66 and a second 68 one of the washing assemblies 42 has a plurality of teeth 70. The teeth 70 of the first one 66 of the washing assemblies 42 are longer than the teeth 70 of the second one 68 of the washing assemblies 42 wherein the first one 66 of the washing assemblies 42 is configured for managing long hair and the second one 68 of the washing assemblies 42 is configured for managing short hair. The cleaning attachment 50 of a third 72 and a fourth 74 one of the washing assemblies 42 is porous wherein the third 72 and fourth 74 one of the washing assemblies 42 are configured to absorb a liquid such that the liquid is transferred from the cleaning attachment 50 to a body of the user when the cleaning attachment 50 is rubbed against the user's body. The liquid may be shampoo, conditioner, or body soap. The cleaning attachment 50 of the fourth 74 one of the washing assemblies 42 is softer than the cleaning attachment 50 of the third one 72 of the washing assemblies 42 wherein the cleaning attachment 50 of the fourth one 74 of the washing assemblies 42 is configured for cleaning the body of an infant. The assembly 10 detangles hair, cleanses the scalp, and stimulates circulation both effectively and efficiently.

A vibrational unit 76 and a battery compartment 78 are positioned in the head 12. The vibrational unit 76 is positioned above the groove 24. The battery compartment 78 is configured for holding a battery 80 and is positioned on one of the ends 58 of the head 12. The battery compartment 78 is electrically coupled to the vibrational unit 76 wherein the battery compartment 78 activates the vibrational unit 76 thereby causing the vibrational unit 76 to oscillate when the battery 80 delivers power to the vibrational unit 76. A control 82 is coupled to the head 12 and is positioned in the lower portion 22 of the peripheral wall 18. The control 82 is positioned on one of the ends 58 of the head 12 opposite the battery compartment 78. The control 82 is operationally coupled to the vibrational unit 76 and the battery compartment 78 wherein selectively manipulating the control 82 activates the vibrational unit 76. The control 82 further comprises a first speed setting 84 and a second speed setting 86 wherein the first and second speed settings 84, 86 determine a speed of the vibrational unit 76. The first speed setting 84 is slower than the second speed setting 86.

A plurality of wires 88 is positioned in the head 12. The wires 88 electrically couple the battery compartment 78 to the vibrational unit 76 and the control 82. A strap 90 is coupled to the head 12 and extends across the top side 14 of the head 12. The strap 90 is resiliently flexible and extends between a right side 92 and a left side 94 of the head 12. The strap 90 is preferably elastic. Each of a first side 96 and a second side 98 of the strap 90 is coupled to the lip 40. The first side 96 of the strap 90 is positioned proximate the control 82. An opening 100 is formed between the top side 14 and the strap 90 wherein the opening 100 is configured to receive a hand of the user to facilitate washing of the user's hair and body.

The assembly 10 has a height between approximately 1 centimeter and 10 centimeters. The assembly 10 has a length between approximately 3 centimeters and 18 centimeters. The assembly 10 has a width between approximately 2 centimeters and 15 centimeters. The head 12 and the tab 46 and top surface 44 of the washing assemblies 42 are made from waterproof materials and are preferably plastic.

In use, as stated above and shown in the Figures, the user's hand is placed in the opening 100. The desired cleaning attachment 50 is selected and the tab 46 is slidably inserted into the groove 24. The liquid, including shampoo, conditioner, body wash, or the like, is then poured onto the cleaning attachment 50. The control 82 is manipulated to either the first speed setting 84 or the second speed setting 86 as desired. The cleaning attachment 50 is positioned over the user's scalp or body to clean the user.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. An exfoliating brush assembly comprising:

a head having a bottom side and a peripheral wall extending upwardly from said bottom side, said peripheral wall having an upper portion coupled to a lower portion;

a groove extending through said bottom side wherein said groove extends from a first side to a second side of said head, said groove extending upwardly into said peripheral wall, said groove extending upwardly into said lower portion of said peripheral wall;

a plurality of washing assemblies, each of said washing assemblies being selectively couplable to said head wherein said washing assemblies are configured for cleaning a body of a user, each of said washing assemblies having a tab wherein said tab has a size and shape corresponding to said groove such that said tab is configured to interlock with said groove when said tab is slidably inserted into said groove, each of said washing assemblies being selectively couplable to said bottom side of said head, each of said washing assemblies comprising a top surface, a locking mechanism coupled to said tab wherein said locking mechanism is configured to couple said head to an associated one of said washing assemblies, and a cleaning attachment, said cleaning attachment extending downwardly from said top surface, said cleaning attachment of a first and a second one of said washing assemblies having a plurality of teeth, said teeth of said first one of said washing assemblies being longer than said teeth of said second one of said washing assemblies wherein said first one of said washing assemblies is configured for managing long hair and said second one of said washing assemblies is configured for managing short hair;

a vibrational unit positioned in said head;

a battery compartment positioned in said head, said battery compartment being configured for holding a battery, said battery compartment being electrically coupled to said vibrational unit wherein said battery compartment activates said vibrational unit thereby causing said vibrational unit to oscillate when the battery delivers power to said vibrational unit;

a strap coupled to said head, said strap extending across a top side of said head;

an opening being formed between said top side and said strap wherein said opening is configured to receive a hand of the user to facilitate washing of the user's hair and body;

a lip coupled to said upper portion of said peripheral wall.

2. The assembly of claim 1, further comprising said strap being resiliently flexible.

3. The assembly of claim 1, further comprising said strap extending between a right side and a left side of said head.

4. The assembly of claim 1, further comprising a control coupled to said head, said control being operationally coupled to said vibrational unit and said battery compartment wherein selectively manipulating said control activates said vibrational unit.

5. The assembly of claim 4, further comprising said control further comprising a first speed setting and a second speed setting wherein said first and second speed settings determine a speed of said vibrational unit, said first speed setting being slower than said second speed setting.

6. The assembly of claim 1, further comprising said lip extending outwardly from a top peripheral edge of said head, said lip extending a full length around said top side of said head.

7. The assembly of claim 1, further comprising:

a first end of said cleaning attachment being positioned in an interior space of said top surface; and a second end of said cleaning attachment being positioned opposite said first end of said cleaning attachment wherein said second end of said cleaning attachment is configured for cleaning a user.

8. The assembly of claim 1, further comprising:

said cleaning attachment of a third and a fourth one of said washing assemblies being porous wherein said third and fourth one of said washing assemblies are configured to absorb a liquid such that the liquid is transferred from said cleaning attachment to a body of the user when said cleaning attachment is rubbed against the body of the user; and said cleaning attachment of said fourth one of said washing assemblies being softer than said cleaning attachment of said third one of said washing assemblies wherein said cleaning attachment of said fourth one of said washing assemblies is configured for cleaning the body of an infant.

9. The assembly of claim 1, further comprising said cleaning attachment extending from the first side to the second side of said head and further extending between a pair of opposite ends of said head.

10. The assembly of claim 1, further comprising said groove having a pair of angled side portions coupling a top edge of said groove and a bottom peripheral edge of said head, said side portions of said groove extending upwardly and outwardly from said bottom peripheral edge.

11. The assembly of claim 10, further comprising said tab projecting upwardly from the top surface of each of said washing assemblies, said tab having a top edge and a pair of angled side portions wherein said top edge is coupled to said side portions of said tab.

12. The assembly of claim 1, further comprising a top edge of said groove being offset from a top peripheral edge and a bottom peripheral edge of said head, said top edge of said groove being parallel to a bottom perimeter edge of the upper portion of said peripheral wall.

13. An exfoliating brush assembly comprising:

a head having a top side, a bottom side, and a peripheral wall extending between said top side and said bottom side, said peripheral wall having an upper portion coupled to a lower portion, said head being substantially oval-shaped;

a groove extending through said bottom side wherein said groove extends from a first side to a second side of said head, said groove extending upwardly into said lower portion of said peripheral wall, a top edge of said groove being offset from a top peripheral edge and a bottom peripheral edge of said head, said top edge of said groove being parallel to a bottom perimeter edge of said upper portion of said peripheral wall, said groove having a pair of angled side portions, said side portions coupling said top edge of said groove and said bottom peripheral edge of said head, said side portions extending upwardly and outwardly from said bottom peripheral edge;

a lip extending outwardly from said top peripheral edge, said lip extending a full length around said top side of said head, said lip being coupled to said upper portion of said peripheral wall;

a plurality of washing assemblies, each of said washing assemblies being selectively couplable to said bottom side, each of said washing assemblies comprising a top surface, said top surface being substantially oval-shaped, an upwardly projecting tab coupled to said top surface, said tab having a top edge coupled to a pair of angled side portions wherein said tab has a size and shape corresponding to said groove such that said tab is configured to interlock with said groove when said tab is slidably inserted into said groove, a locking mechanism coupled to said tab wherein said locking mechanism is configured to couple said head to an associated one of said washing assemblies, said locking mechanism being coupled to a first end of said tab, said locking mechanism being centrally positioned on said top edge of said tab, and a cleaning attachment, said cleaning attachment extending downwardly from said top surface, said cleaning attachment extending from said first side to said second side of said head and further extending between a pair of opposite ends of said head, a first end of said cleaning attachment being positioned in an interior space of said top surface, a second end of said cleaning attachment being positioned opposite said first end of said cleaning attachment wherein said second end of said cleaning attachment is configured for cleaning a user, said cleaning attachment of a first and a second one of said washing assemblies having a plurality of teeth, said teeth of said first one of said washing assemblies being longer than said teeth of said second one of said washing assemblies wherein said first one of said washing assemblies is configured for managing long hair and said second one of said washing assemblies is configured for managing short hair, said cleaning attachment of a third and a fourth one of said washing assemblies being porous wherein said third and fourth one of said washing assemblies are configured to absorb a liquid such that the liquid is transferred from said cleaning attachment to a body of the user when said cleaning attachment is rubbed against the body of the user, said cleaning attachment of said fourth one of said washing assemblies being softer than said cleaning attachment of said third one of said washing assemblies wherein said cleaning attachment of said fourth one of said washing assemblies is configured for cleaning the body of an infant;

a vibrational unit positioned in said head, said vibrational unit being positioned above said groove;

a battery compartment positioned in said head, said battery compartment being configured for holding a battery, said battery compartment being positioned on one of said ends of said head, said battery compartment being electrically coupled to said vibrational unit wherein said battery compartment activates said vibrational unit thereby causing said vibrational unit to oscillate when the battery delivers power to said vibrational unit;

a control coupled to said head, said control being positioned in said lower portion of said peripheral wall, said control being positioned on one of said ends of said head opposite said battery compartment, said control being operationally coupled to said vibrational unit and said battery compartment wherein selectively manipulating said control activates said vibrational unit, said control further comprising a first speed setting and a second speed setting wherein said first and second speed settings determine a speed of said vibrational unit, said first speed setting being slower than said second speed setting;

a plurality of wires positioned in said head, said wires electrically coupling said battery compartment to said vibrational unit and said control;

a strap coupled to said head, said strap extending across said top side of said head, said strap extending between a right side and a left side of said head, each of a first side and a second side of said strap being coupled to said lip, said first side of said strap being positioned proximate said control, said strap being resiliently flexible; and an opening being formed between said top side and said strap wherein said opening is configured to receive a hand of the user to facilitate washing of the user's hair and body.

* * * * *